US007158085B2

(12) United States Patent
Shin et al.

(10) Patent No.: US 7,158,085 B2
(45) Date of Patent: Jan. 2, 2007

(54) ANTENNA APPARATUS FOR SLIDING-TYPE PORTABLE TERMINAL

(75) Inventors: Yong-Joo Shin, Yongin-si (KR); Wan-Jin Choi, Suwon-si (KR)

(73) Assignee: Samsung Electronics Co., Ltd. (KR)

( * ) Notice: Subject to any disclaimer, the term of this patent is extended or adjusted under 35 U.S.C. 154(b) by 0 days.

(21) Appl. No.: 11/081,215

(22) Filed: Mar. 16, 2005

(65) Prior Publication Data

US 2005/0264457 A1 Dec. 1, 2005

(30) Foreign Application Priority Data

Jun. 1, 2004 (KR) ..... 10-2004-0039596

(51) Int. Cl.
*H01Q 1/24* (2006.01)

(52) U.S. Cl. ..... 343/702

(58) Field of Classification Search ..... 343/702, 343/882, 889, 903

See application file for complete search history.

(56) References Cited

U.S. PATENT DOCUMENTS

| | | | | |
|---|---|---|---|---|
| 6,208,874 | B1 | 3/2001 | Rudisill et al. | 455/550 |
| 6,429,817 | B1 * | 8/2002 | Creigh et al. | 343/702 |
| 6,441,789 | B1 * | 8/2002 | Sasano | 343/702 |
| 6,903,694 | B1 * | 6/2005 | Kim | 343/702 |
| 2001/0009847 | A1 | 7/2001 | Kim et al. | 455/575.4 |
| 2003/0137468 | A1 * | 7/2003 | Kim | 343/895 |

FOREIGN PATENT DOCUMENTS

| | | |
|---|---|---|
| EP | 0 459 391 | 5/1991 |
| EP | 1 111 712 | 6/2001 |
| FR | 2 802 046 | 12/1999 |

* cited by examiner

*Primary Examiner*—Shih-Chao Chen
*Assistant Examiner*—Minh Dieu A
(74) *Attorney, Agent, or Firm*—The Farrell Law Firm

(57) ABSTRACT

Disclosed is an antenna apparatus for a sliding-type portable terminal having a first housing and a second housing adapted to slide along the longitudinal direction of the first housing including an external antenna having a stationary antenna portion extending along the longitudinal direction and having an end fixed on the first housing and at least one movable antenna portion extending along the longitudinal direction and having the other end fixed to the second housing so that, as the second housing slides, it retracts in and extends out of the stationary antenna portion. The antenna apparatus for a sliding-type portable terminal has an external antenna which, together with the embedded antenna, compensates for the deteriorated performance of the embedded antenna during a speech mode. In addition, the antenna apparatus does not affect the design of the terminal and provides various types of terminal design, because it does not protrudes out of the terminal.

5 Claims, 6 Drawing Sheets

ANTENNA APPARATUS FOR SLIDING-TYPE PORTABLE TERMINAL

PRIORITY

This application claims priority to an application entitled "Antenna Apparatus For Sliding-type Portable Terminal" filed with the Korean Intellectual Property Office on Jun. 1, 2004 and assigned Ser. No. 2004-39596, the contents of which are hereby incorporated by reference.

BACKGROUND OF THE INVENTION

1. Field of the Invention

The present invention relates to a portable terminal, and more particularly to an antenna apparatus for a sliding-type portable terminal.

2. Description of the Related Art

In general, a "portable terminal" refers to an apparatus which a user can carry with him to perform wireless communication with a desired partner. Portable terminals are classified as either bar-type terminals, flip-type terminals, or folder-type terminals according to their appearance. The bar-type terminals have a single housing shaped like a bar. The flip-type terminals have a flip or a cover which is rotatably coupled to a bar-shaped housing by a hinge device. The folder-type terminals have a folder which is connected to a single bar-shaped housing by a hinge device in such a manner that the folder can be rotated to be folded on or unfolded from the housing.

Portable terminals may also be classified into rotation-type terminals and sliding-type terminals according to ways of opening and closing the terminals. In the rotation-type terminals, two housings are connected to each other in such a manner that one housing is rotated to be opened or closed relative to the other while they face each other. In the sliding-type terminals, one of their two housings is slid along a longitudinal direction to be opened or closed relative to the other while they face other. These variously classified portable terminals can be easily understood by those skilled in the art.

Portable terminals are equipped with an antenna apparatus to guarantee the quality of signals which are transmitted to and received from base stations and repeaters for mobile communication.

More specifically, portable terminals are conventionally equipped with an antenna apparatus which is a combination of a helical antenna and a rod antenna. The helical antenna is operated only in a region having a good radio environment. The rod antenna normally retracts in the terminals and, if necessary, extends out of the terminals for service.

Conventional antenna apparatuses are mounted on terminals in such a manner that they protrude out of the terminals. This is a hindrance to the diversified design of terminals and limits portability. In addition, the antenna apparatuses may be easily fractured by an external shock (e.g., when dropped).

For these reasons, research is currently being performed to develop an embedded antenna which is positioned within the terminals. Some manufacturers of portable terminals have already commercialized terminals which are equipped with such an embedded antenna.

However, the embedded antenna has a problem in that it has a decreased gain compared with conventional antennas which protrude out of the terminals. In the case of sliding-type terminals wherein one of a pair of the terminal housings slides and passes over the other in a speech mode, any one of the housings acts as a ground surface for the embedded antenna apparatus. This further decreases the performance of the antenna apparatus.

SUMMARY OF THE INVENTION

Accordingly, the present invention has been made to solve the above-mentioned problems occurring in the prior art, and an object of the present invention is to provide an antenna apparatus for a sliding-type portable terminal capable of exhibiting excellent performance without any hindrance to the design of the terminal.

In order to accomplish this object, there is provided an antenna apparatus for a sliding-type portable terminal having a first housing and a second housing adapted to slide along the longitudinal direction of the first housing, the antenna apparatus including an external antenna composed of a stationary antenna portion extending along the longitudinal direction and having an end fixed on the first housing and at least one movable antenna portion extending along the longitudinal direction and having the other end fixed to the second housing so that, as the second housing slides, it retracts in and extends out of the stationary antenna portion.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF THE PREFERRED EMBODIMENT

Hereinafter, preferred embodiments of the present invention will be described with reference to the accompanying drawings. In the following description of the present invention, a detailed description of known functions and configurations incorporated herein will be omitted when it may make the subject matter of the present invention unclear.

Figure 1:
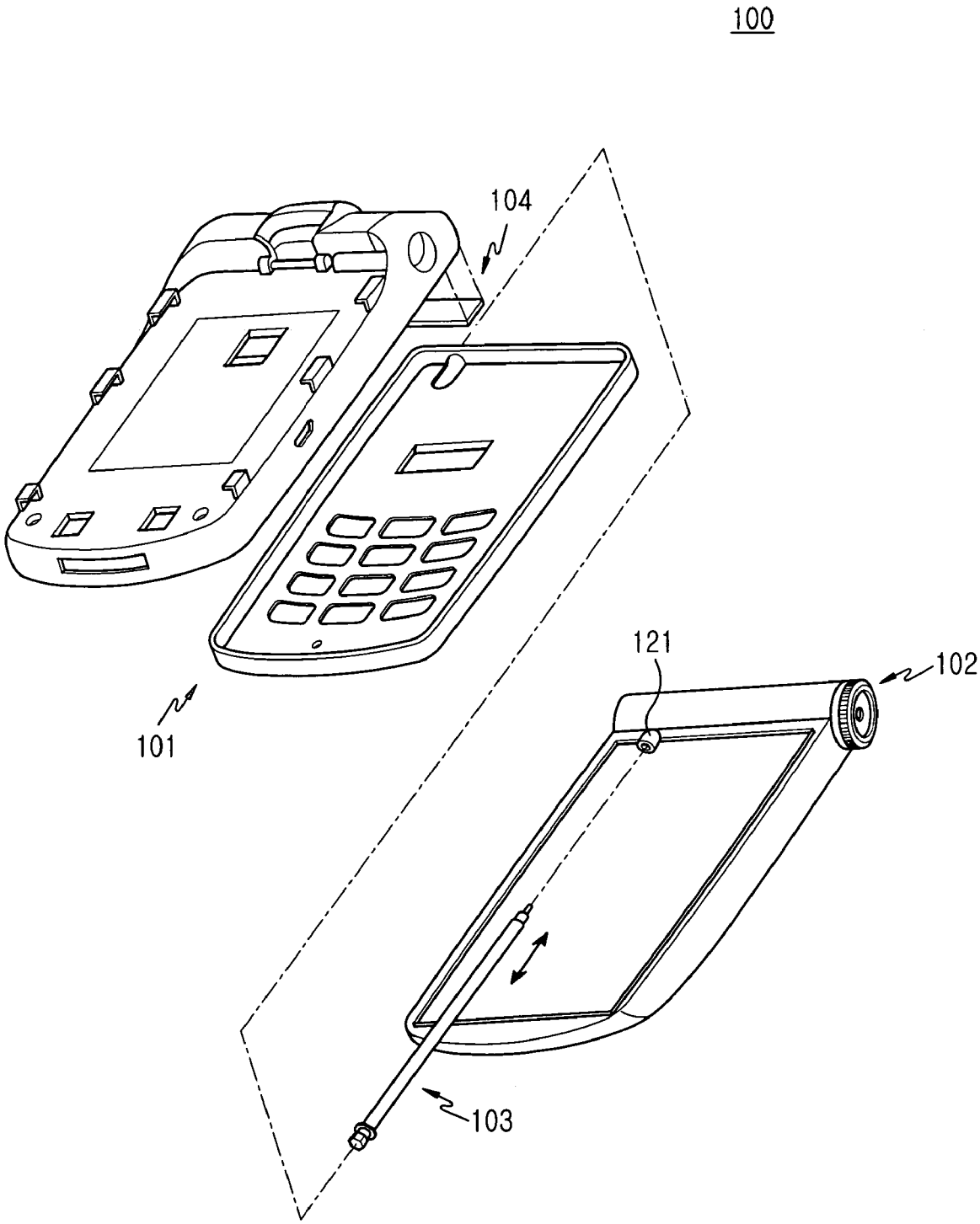
FIG. 1 is an exploded perspective view showing a sliding-type portable terminal equipped with an antenna apparatus according to a preferred embodiment of the present invention.
Figure 2:
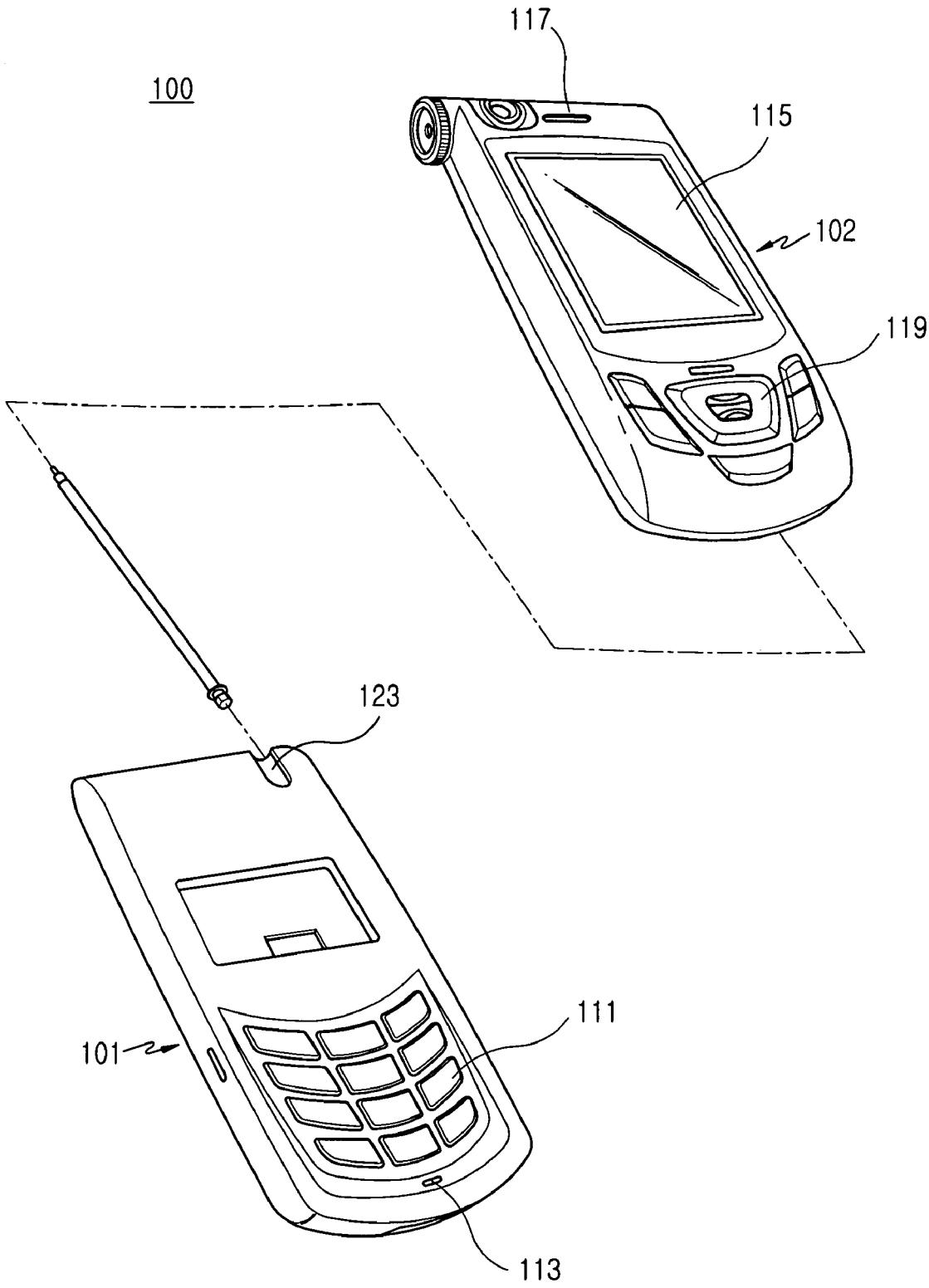
FIG. 2 is an exploded perspective view of the sliding-type portable terminal shown in FIG. 1, when viewed from a different direction.

FIG. 1 is an exploded perspective view showing a sliding-type portable terminal equipped with an antenna apparatus according to a preferred embodiment of the present invention and FIG. 2 is an exploded perspective view of the sliding-type portable terminal shown in FIG. 1, when viewed from a different direction.

As shown in FIGS. 1 and 2, a sliding-type portable terminal 100 is equipped with an antenna apparatus that is comprised of external antenna 103 and embedded antenna 104, and first and second housings 101 and 102 according to a preferred embodiment of the present invention.

The first housing 101 has a first keypad 111 having a number of keys positioned on the front surface thereof, a transmitter unit 113 containing a microphone therein, and a through-hole 123 formed on the upper end thereof.

The second housing 102 has a display device 115 positioned on the front surface thereof, a receiver unit 117 containing a speakerphone therein, and a second keypad 119 having function keys. The second housing 102 is adapted to slide on the front surface of the first housing 101. The keypad 111 and the transmitter unit 113 are opened and closed as the second housing 102 slides on the first housing 101.

The antenna apparatus 103 and 104 of the portable terminal 100 includes an embedded antenna 104 positioned in the first housing 101 and an external antenna 103 adapted to retract in and extend out of the first housing 101.

The embedded antenna 104 may be made up of any type of antenna, including a micro-strip antenna, a chip antenna, and an inverted F antenna, as long as it meets the performance requirements in relation to the terminal 100 and does not limit the design of the terminal.

Figure 3:
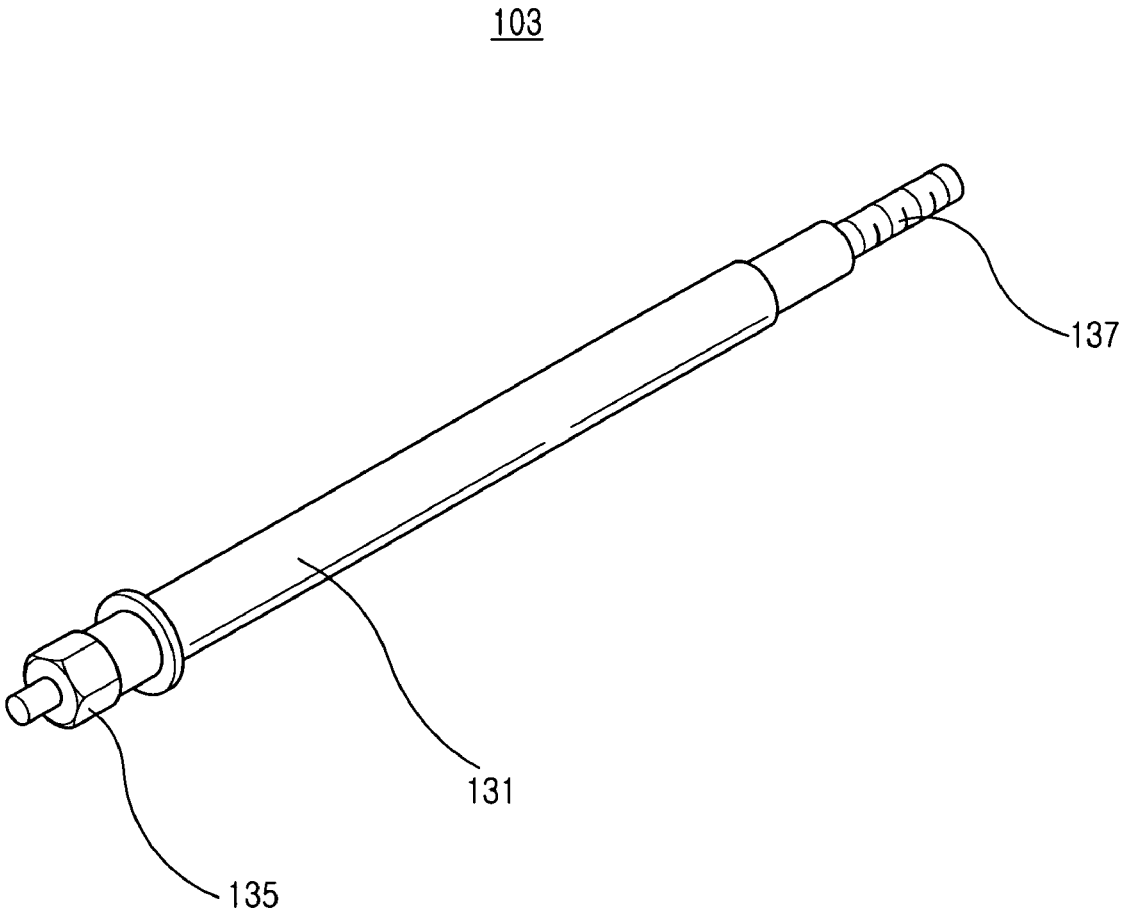
FIG. 3 is a perspective view of the antenna apparatus shown in FIG. 1.
Figure 4:
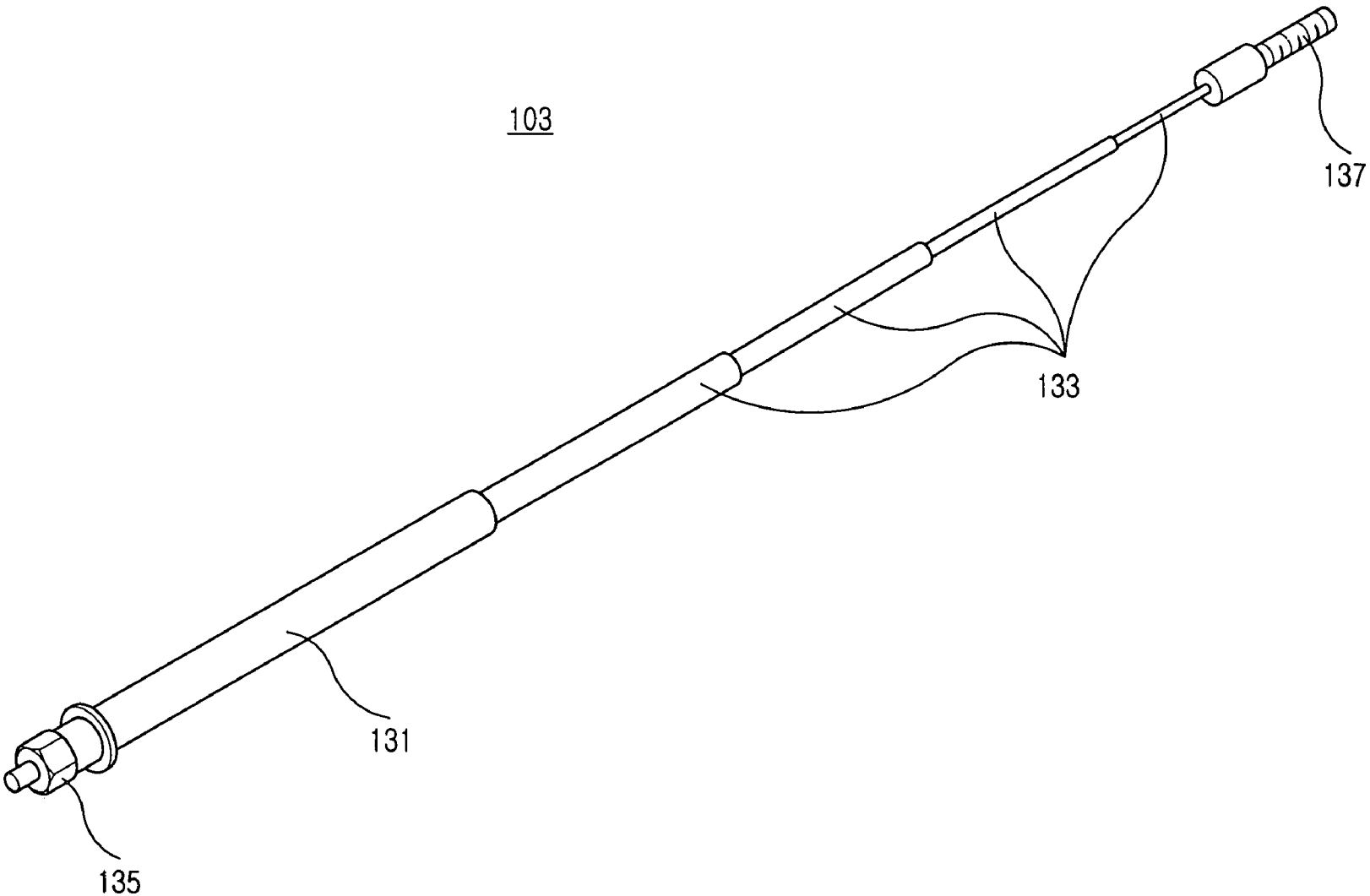
FIG. 4 is a perspective view of a movable antenna portion of the antenna apparatus shown in FIG. 1, which has been extended.

Referring to FIGS. 3 and 4, the external antenna 103 includes a stationary antenna portion 131 and a movable antenna portion 133. The stationary antenna portion 131, which is shaped as a tube, extends along a longitudinal direction and has an end 135 fixed on the first housing 101. The movable antenna portion 133, which also is shaped as a tube, extends along the longitudinal direction and is adapted to retract in and extend out of the stationary antenna portion 131. The movable antenna portion 133 may also include a series of tubes that retract in and extend out of each other.

As shown in FIG. 4, at least one movable antenna portion 133 makes it possible to increase the overall length of the external antenna 103. The other end 137 of the movable antenna portion 133 is fixed to the second housing 102 so that, as the second housing 102 slides, the movable antenna portion 133 can retract in and extend out of the stationary antenna portion 131. As such, the movable antenna portion 133 is moved in such a manner that, as the second housing 102 slides, it retracts in and extends out of the stationary antenna portion 131.

The external antenna 103, configured as above, is inserted through the through-hole 123 of the first housing 101 so that an end 135 of the stationary antenna portion 131 is fixed to the interior of the first housing 101 and the other end 137 of the movable antenna portion 133 is fixed to a fixation protrusion 121 formed on the rear surface of the second housing 102. The ends 135 and 137 of the stationary and movable antenna portions 131 and 133 may be provided with a fastening means, such as a thread, respectively.

Since the stationary and movable antenna portions 131 and 133 are fixed to the first and second housings 101 and 102 via the ends 135 and 137, respectively, the movable antenna portion 133 extends out of the stationary antenna portion 131 as the second housing 102 slides.

Figure 5:
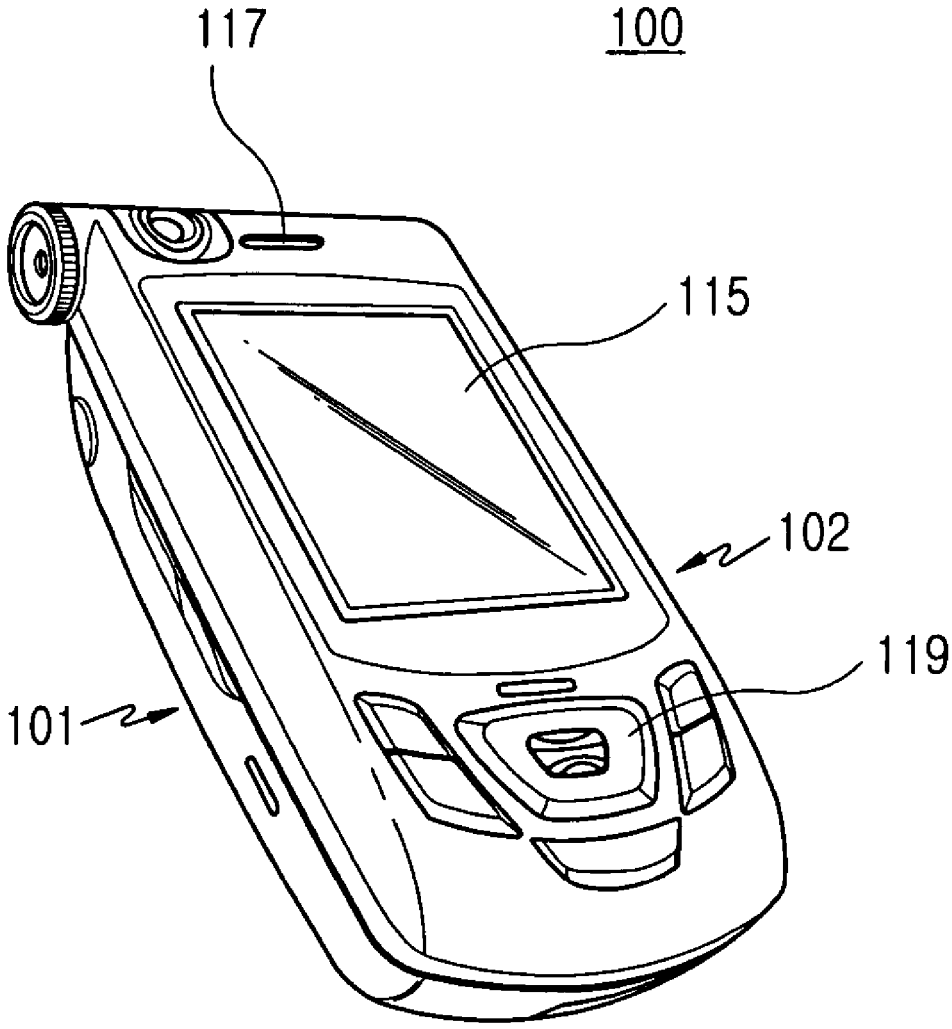
FIG. 5 is a perspective view of the portable terminal shown in FIG. 1.
Figure 6:
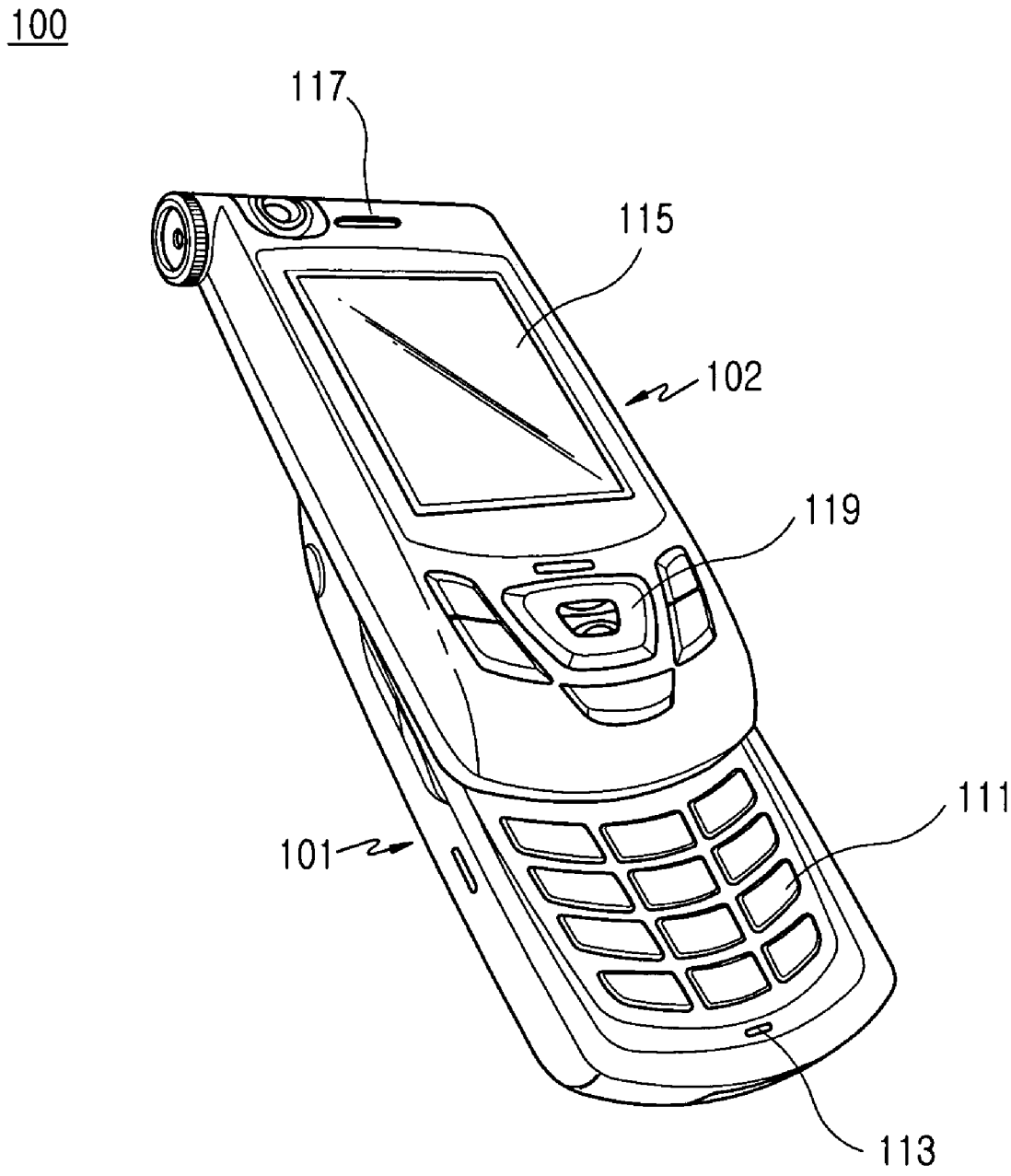
FIG. 6 is a perspective view of the portable terminal shown in FIG. 1. showing a second housing which has been slid open with respect to a first housing.

FIGS. 5 and 6 are perspective views of the sliding-type portable terminal 100. FIG. 5 corresponds to a standby mode wherein the second housing 102 is folded on the first housing 101, and FIG. 6 corresponds to a speech mode wherein the second housing 102 has been slid to the upper portion of the first housing 101.

When the second housing 102 is folded on the first housing 101, as shown in FIG. 5, the movable antenna portion 133 of the external antenna 103 retracts in the stationary antenna portion 131 as shown in FIG. 3. When the second housing 102 has been slid to the upper portion of the first housing 101, as shown in FIG. 6, the movable antenna portion 133 of the external antenna 103 extends out of the stationary antenna portion 131 as shown in FIG. 4.

When the movable antenna portion 133 is retracted in the stationary antenna portion 131, most of the output radio signals generated from the terminal 100 is transmitted via the embedded antenna 104. When the second housing 102 has been slid to the upper portion of the first housing 101, the radio signals output via the embedded antenna 104 is limited and most of the output radio signals generated from the terminal 100 is transmitted via the external antenna 103.

The gain and efficiency of a conventional sliding-type portable terminal equipped with only an embedded antenna and those of a sliding-type portable terminal 100 equipped with an antenna apparatus 103 and 104 (i.e., an embedded antenna 103 and an external antenna 104) according to a preferred embodiment of the present invention have been measured according to mobile communication service modes. The measurement data is given below in Table 1.

In Table 1, "slide down" refers to a state wherein the second housing 102 of the terminal 100 has been folded on the first housing 101 and "slide up" refers to a state wherein the second housing 102 of the terminal 100 has been slid to the upper portion of the first housing 101.

As is clear from Table 1, the antenna apparatus 103 and 104 according to the present invention has improved gain and efficiency, compared with the conventional terminal equipped with only an embedded antenna, by operating the embedded antenna 104 and the external antenna 103 together on the portable terminal 100.

TABLE 1

| Classification | | Measurement item | CDMA | USPCS |
|---|---|---|---|---|
| Embedded antenna | Slide down | Maximum gain (dBm) | 0.3 | 0.9 |
| | | Average gain (dBm) | −3.5 | −3.4 |
| | | Efficiency (%) | 45 | 46 |
| | Slide up | Maximum gain (dBm) | −2.3 | −1.5 |
| | | Average gain (dBm) | −6.2 | −6.7 |
| | | Efficiency (%) | 24 | 22 |
| Embedded and external antennas | Slide down | Maximum gain (dBm) | 0.6 | 3.0 |
| | | Average gain (dBm) | −3.1 | −2.8 |
| | | Efficiency (%) | 48 | 52 |
| | Slide up | Maximum gain (dBm) | −1.6 | 2.0 |
| | | Average gain (dBm) | −4.5 | −5.4 |
| | | Efficiency (%) | 35 | 31 |

As mentioned above, the antenna apparatus for a sliding-type portable terminal according to the present invention has an external antenna which, together with the embedded antenna, compensates for the deteriorated performance of the embedded antenna during a speech mode without protruding out of the terminal. This improves the performance of the antenna apparatus. In addition, the antenna apparatus according to the present invention does not affect the design of the terminal and provides various types of terminal design, because it does not protrude out of the terminal.

While the invention has been shown and described with reference to certain preferred embodiments thereof, it will be understood by those skilled in the art that various changes in form and details may be made therein without departing from the spirit and scope of the invention as defined by the appended claims.

What is claimed is:

1. An antenna apparatus for a sliding-type portable terminal having a first housing and a second housing adapted to slide along the longitudinal direction of the first housing, the antenna apparatus comprising an external antenna including a stationary antenna portion extending along the longitudinal direction and having an end fixed on the first housing and at least one movable antenna portion extending along the longitudinal direction and having the other end fixed to the second housing so that, as the second housing slides, the movable antenna portion retracts in and extends out of the stationary antenna portion.

2. An antenna apparatus for a sliding-type portable terminal as claimed in claim 1, further comprising an embedded antenna positioned in one of the first and second housings.

3. An antenna apparatus for a sliding-type portable terminal as claimed in claim 1, wherein a through-hole is formed on the upper end surface of the first housing, a fixation protrusion is formed on the upper end of the rear surface of the second housing while facing the through-hole, the stationary antenna portion is contained in the first housing via the through-hole, and the upper end of the movable antenna portion is fixed to the fixation protrusion.

4. An antenna apparatus for a sliding-type portable terminal as claimed in claim 1, wherein the at least one movable antenna portion includes a plurality of tubes reciprocally extending into and out of each other.

5. A method of improving gain and efficiency of a sliding-type portable terminal, comprising the steps of:

providing a first housing of the sliding-type portable terminal with an embedded antenna, wherein the first housing further has a through-hole formed on an upper end surface thereof;

providing a second housing of a sliding-type portable terminal with a fixation protrusion formed on an upper end thereof; and providing an external antenna being retractably opened and closed, fixed at one end in the through-hole of the first housing and fixed at the other end to the fixation protrusion of the second housing, wherein the external antenna is retractably opened and closed as the first and second housings are slidably moveable with respect to one another to open and close the portable terminal.

* * * * *